US006357068B1

(12) United States Patent
Seber et al.

(10) Patent No.: US 6,357,068 B1
(45) Date of Patent: Mar. 19, 2002

(54) COMBINATION TOOL WITH OPPOSITELY DEPLOYING HANDLES

(75) Inventors: Brett P. Seber, Escondido; Randolph J. Morton, Coronado; Gabriel Alejandro Draguicevich, Solana Beach; Roy L. Helton, Jr., San Diego, all of CA (US); Harold J. Carson; Harold J. Carson, Jr., both of Vine Grove, KY (US); Gregory F. Rubin, Escondido, CA (US); William P. Debley, Jr., Winnetka, CA (US); Robson L. Splane, Jr., Granada Hills, CA (US)

(73) Assignee: Buck Knives, Inc., El Cajon, CA (US)

( * ) Notice: Subject to any disclaimer, the term of this patent is extended or adjusted under 35 U.S.C. 154(b) by 984 days.

(21) Appl. No.: 08/584,962

(22) Filed: Jan. 11, 1996

(51) Int. Cl.[7] ..... B25F 1/04

(52) U.S. Cl. ..... 7/129; 7/168; 7/128

(58) Field of Search ..... 7/118, 125–135, 7/167–168; 81/427.5, 177.2, 177.4, 177.6, 411–412; 30/255, 153, 143, 155, 122

(56) References Cited

U.S. PATENT DOCUMENTS

| | | | | | |
|---|---|---|---|---|---|
| 295,885 | A | * | 3/1884 | Pullman | 81/412 |
| 542,601 | A | | 7/1895 | Baker | |
| 589,392 | A | | 8/1897 | Kolar | |
| 592,766 | A | | 11/1897 | Effinger et al. | |
| 596,096 | A | | 12/1897 | Watts | |
| 614,537 | A | | 11/1898 | Dahlquist et al. | |
| 649,334 | A | | 5/1900 | Meloos | |
| 662,005 | A | | 11/1900 | Lewis | |
| 790,432 | A | | 5/1905 | Heilrath | |
| 857,459 | A | | 6/1907 | Hendrickson | |
| 858,003 | A | | 6/1907 | Klever | |
| 896,746 | A | | 8/1908 | McCarty | |
| 1,174,132 | A | | 3/1916 | Dragun | |
| 1,184,746 | A | | 5/1916 | Hanson | |
| 1,187,842 | A | | 6/1916 | Kaas | |
| 1,194,296 | A | | 8/1916 | Jones et al. | |
| 1,334,425 | A | | 3/1920 | Wernimont | |
| 1,370,906 | A | | 3/1921 | Newton | |
| 1,467,661 | A | | 9/1923 | Undy | |
| 1,474,592 | A | | 11/1923 | Jacoby | |

(List continued on next page.)

FOREIGN PATENT DOCUMENTS

| | | | | |
|---|---|---|---|---|
| CH | 277412 | | 11/1951 | |
| DE | 30788 | | 8/1884 | |
| GB | 2463 | | 1/1869 | |
| GB | 17248 | * | 9/1895 | 30/255 |
| GB | 20299 | | 11/1902 | |
| GB | 15859 | | 9/1904 | |
| GB | 13254 | | 9/1905 | |
| GB | 186520 | | 10/1922 | |
| SU | 1002145 | | 3/1983 | |

*Primary Examiner*—D. S. Meislin
(74) *Attorney, Agent, or Firm*—Gregory Garmong

(57) ABSTRACT

A combination tool includes a tool head having a jaw mechanism with two jaws lying in a tool head plane. A first handle is pivotably attached to the jaw mechanism and rotatable in a first direction about a first pivot axle lying in the tool head plane, between a nested position wherein the first handle lies coplanar with and adjacent to the jaw mechanism and a deployed position wherein the first handle is coplanar with and remote from the jaw mechanism. A second handle is pivotably attached to the jaw mechanism and rotatable in a second direction, opposite to the first direction, about a second pivot axle lying in the tool head plane, between a nested position wherein the second handle lies coplanar with and adjacent to the jaw mechanism and a deployed position wherein the second handle is coplanar with and remote from the jaw mechanism. The combination tool further includes a set of blade tools including a first blade pivotably received in the first handle, and a second blade pivotably received in the second handle.

18 Claims, 9 Drawing Sheets

U.S. PATENT DOCUMENTS

| | | | |
|---|---|---|---|
| 1,486,725 | A | 3/1924 | Brown |
| 1,511,340 | A | 10/1924 | Jackson |
| 1,524,694 | A | 2/1925 | DiMaio |
| 1,551,328 | A | 8/1925 | Perry |
| 1,561,833 | A | 11/1925 | Cruickshank |
| 1,561,993 | A | 11/1925 | Nielsen |
| 1,619,181 | A | 3/1927 | Beretz |
| 2,057,201 | A | 10/1936 | McCluskey |
| D137,408 | S | 3/1944 | Frisk |
| 2,514,130 | A | 7/1950 | Jones |
| 2,561,682 | A | 7/1951 | Barnett |
| 2,575,652 | A | 11/1951 | Bovee |
| 2,606,471 | A | 8/1952 | Kollweck |
| 2,641,149 | A | 6/1953 | Peterson |
| 2,747,446 | A | 5/1956 | Eder |
| 3,044,081 | A | 7/1962 | Robinson, Jr. |
| 3,798,687 | A | 3/1974 | Stevens |
| 4,238,862 | A | 12/1980 | Leatherman |
| 4,502,220 | A | 3/1985 | Aoki |
| 4,512,051 | A | 4/1985 | Magan |
| D286,501 | S | 11/1986 | Magan |
| 4,744,272 | A | 5/1988 | Leatherman |
| 4,805,303 | A | 2/1989 | Gibbs |
| 4,888,869 | A | 12/1989 | Leatherman |
| 5,044,079 | A | 9/1991 | Gibbs |
| 5,062,173 | A | 11/1991 | Collins et al. |
| 5,142,721 | A | 9/1992 | Sessions et al. |
| 5,212,844 | A | 5/1993 | Sessions et al. |
| D338,386 | S | 8/1993 | Frazer |
| 5,267,366 | A | 12/1993 | Frazer |
| D356,019 | S | 3/1995 | Sakai |
| 5,491,856 | A * | 2/1996 | Legg |

* cited by examiner

FIG. 1
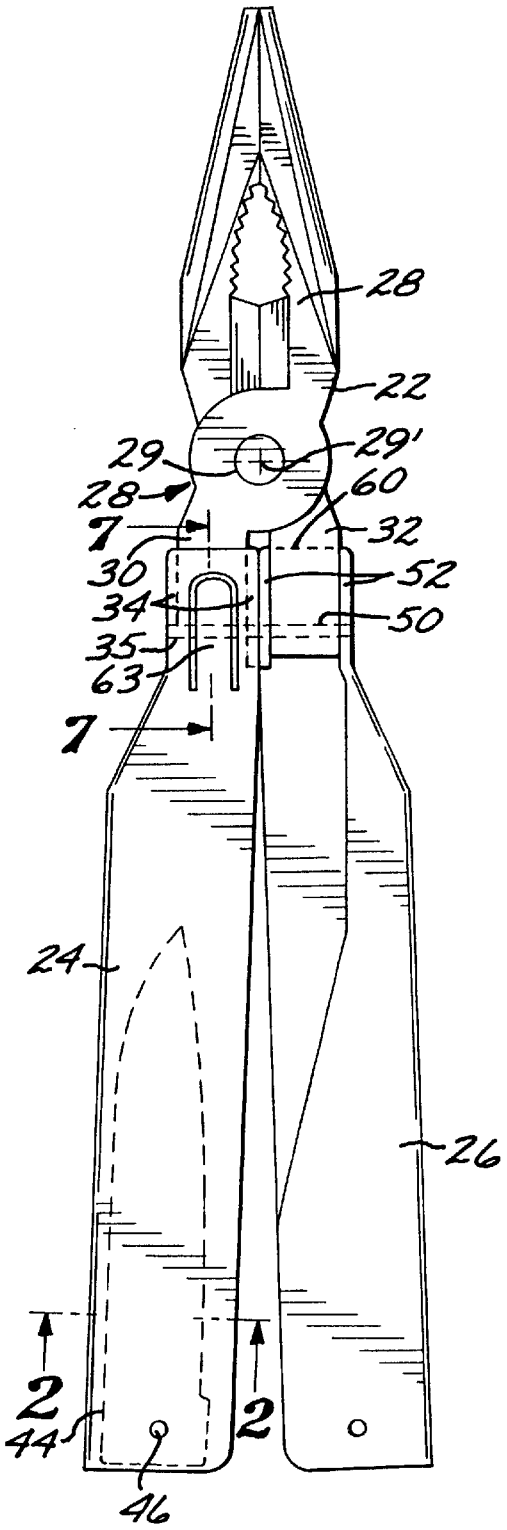
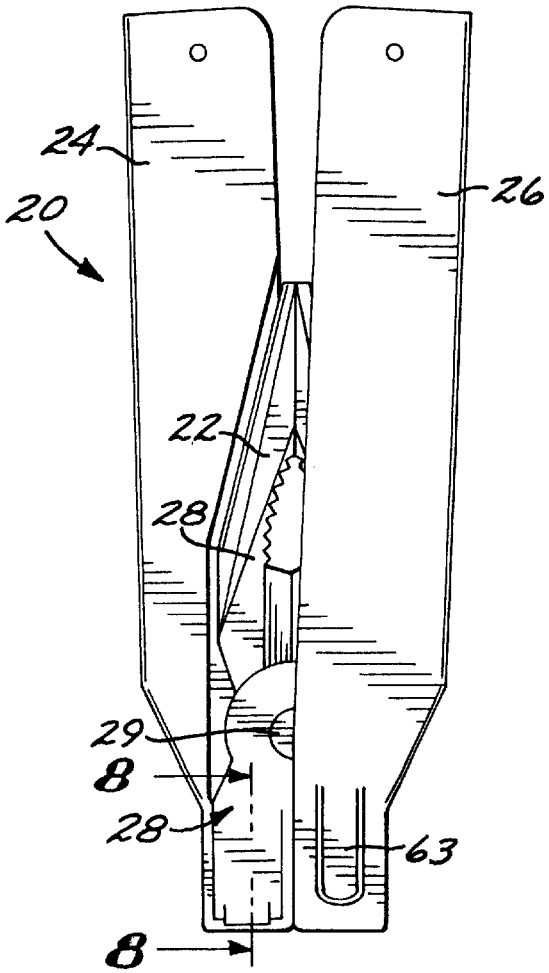
FIG. 3
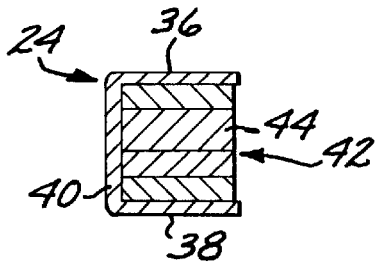
FIG. 2

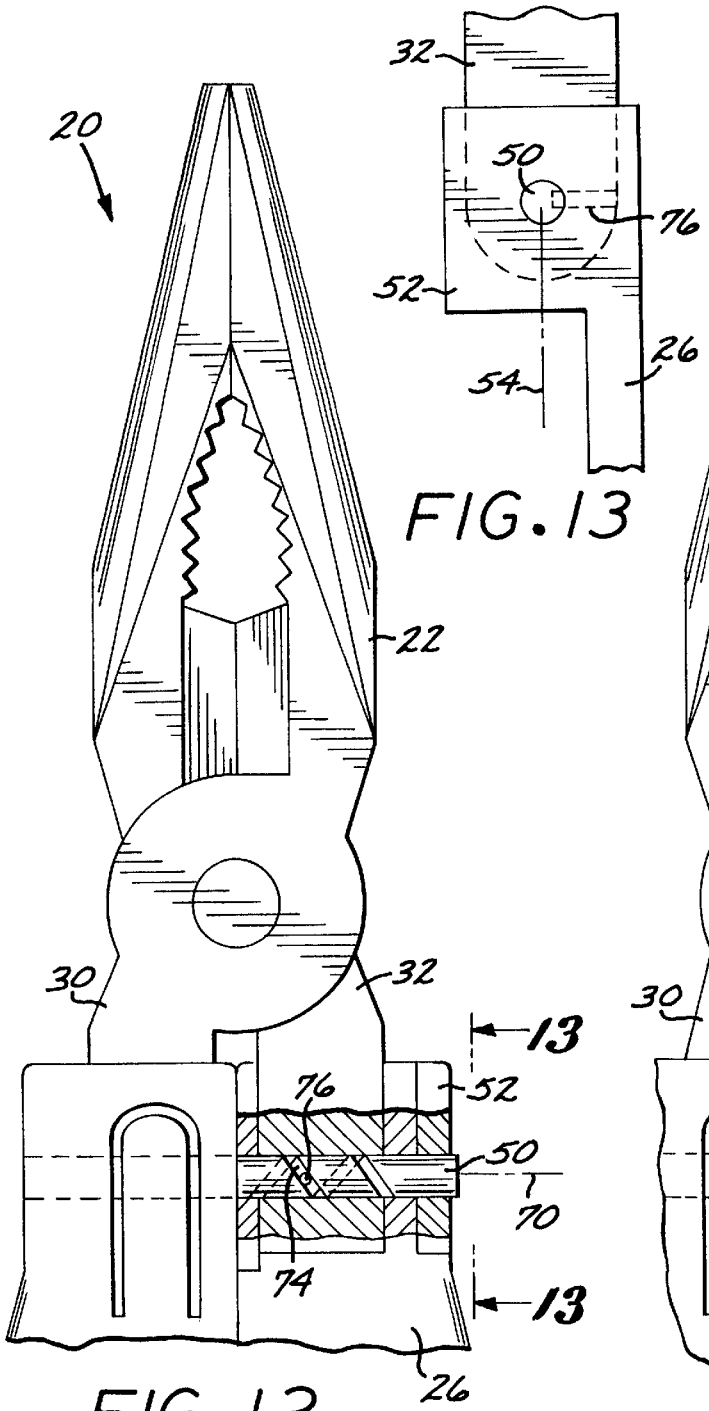
FIG. 12
FIG. 13
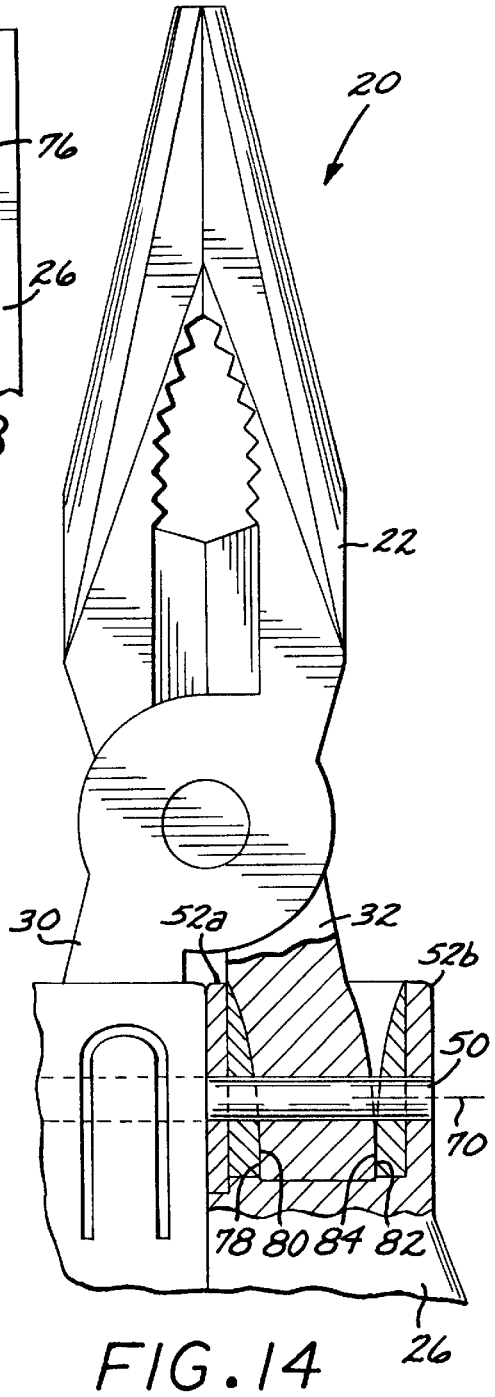
FIG. 14

FIG. 15
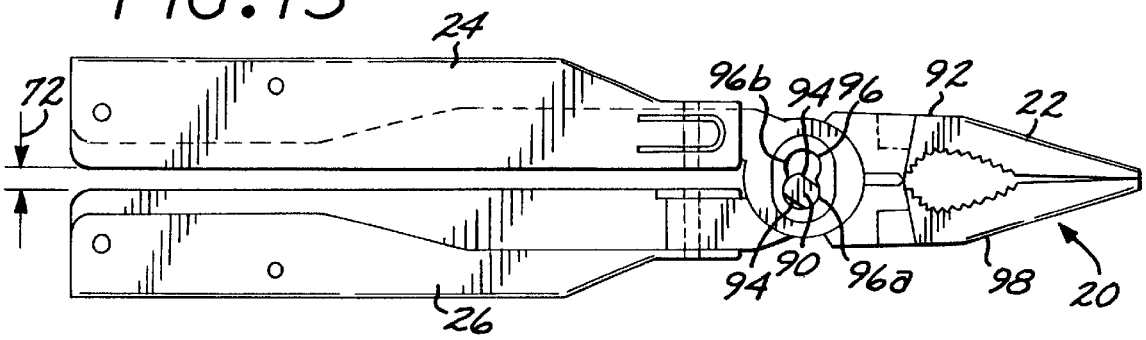
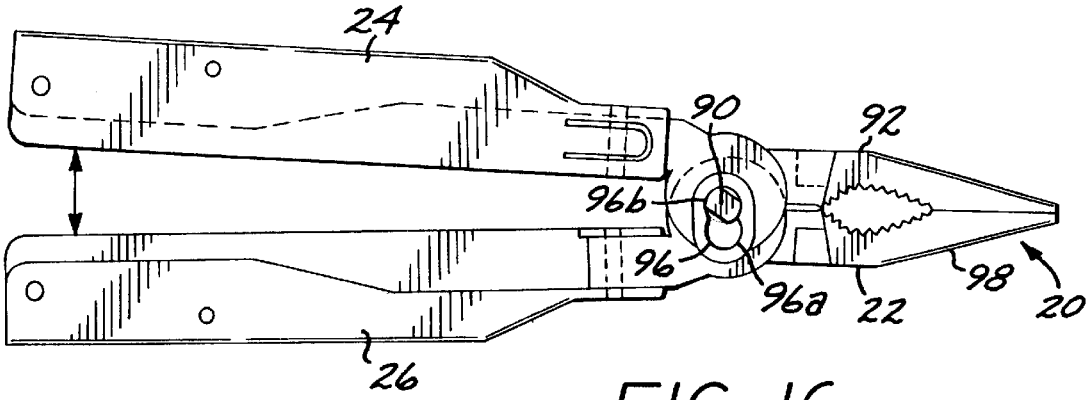
FIG. 16
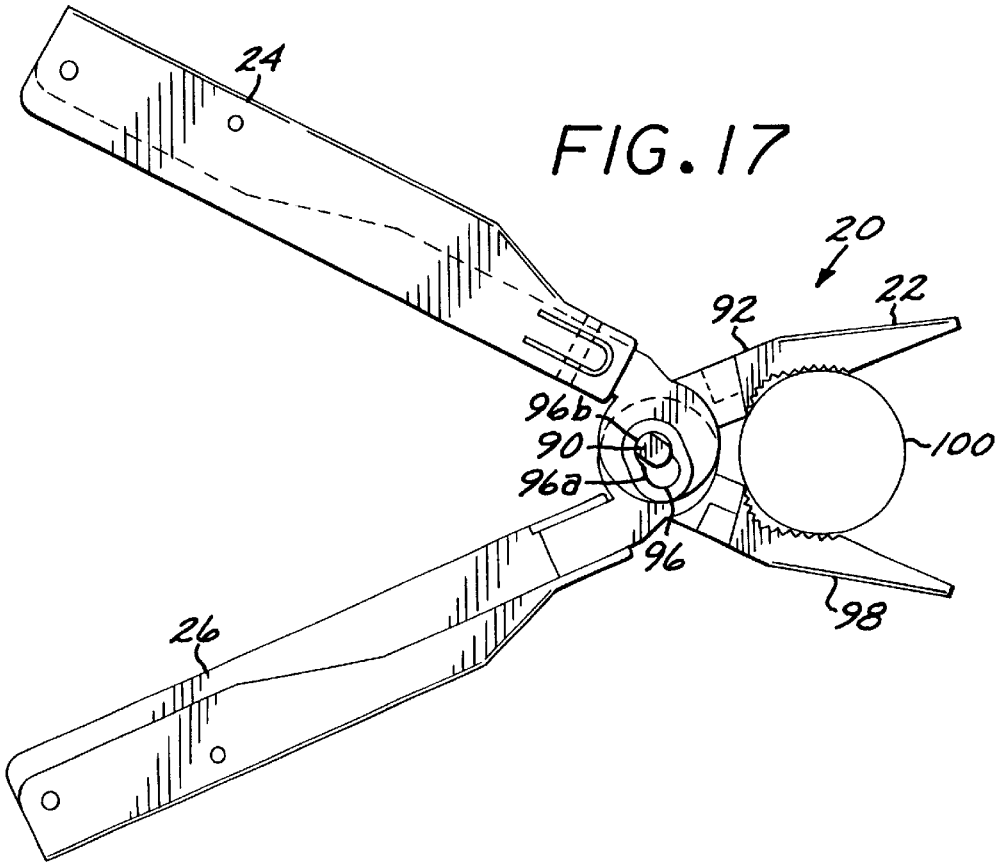
FIG. 17

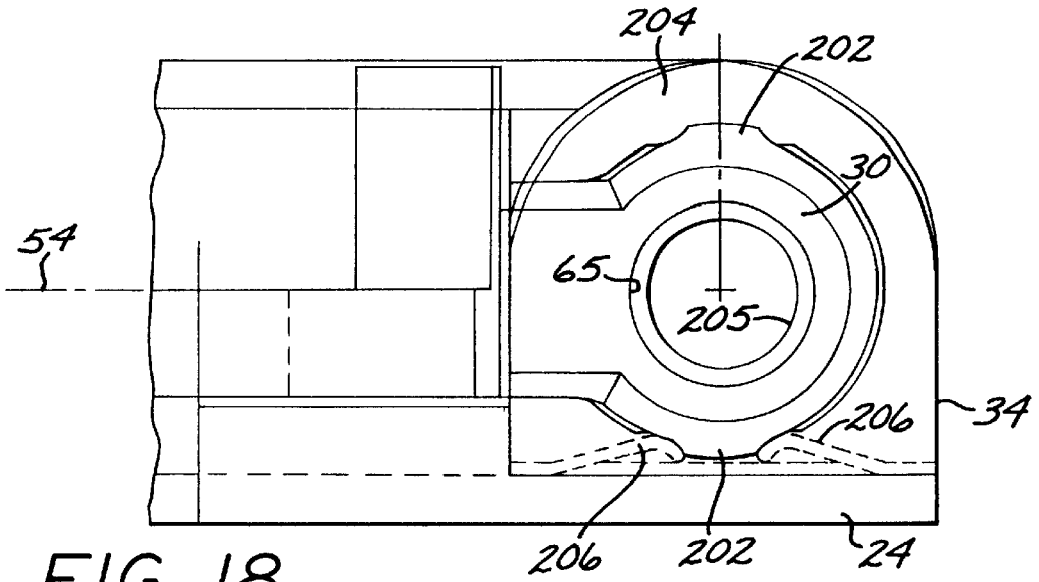
FIG. 18
FIG. 19
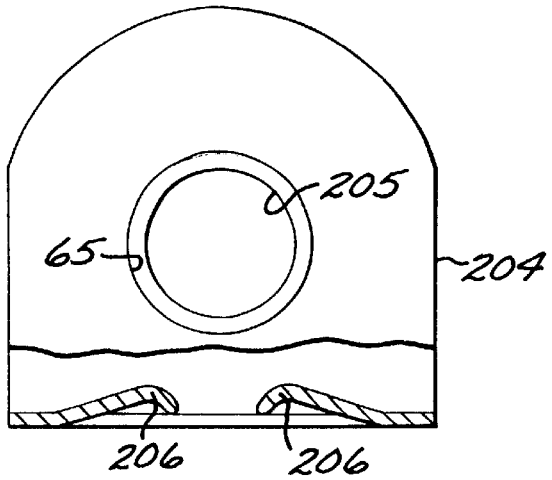
FIG. 20
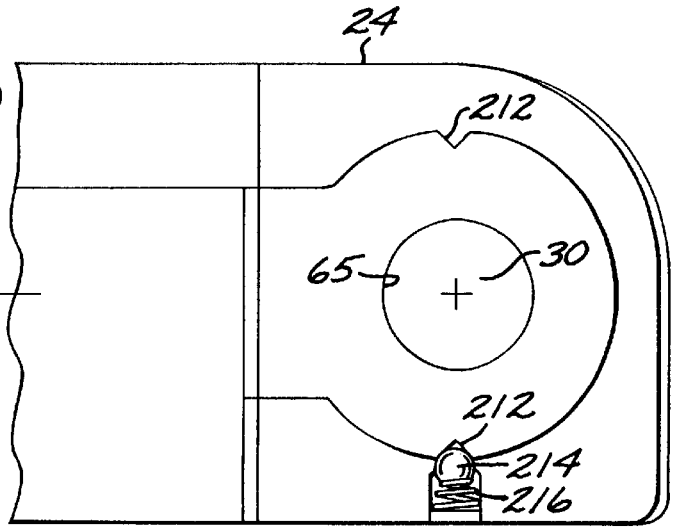

COMBINATION TOOL WITH OPPOSITELY DEPLOYING HANDLES

BACKGROUND OF THE INVENTION

This invention relates to a combination tool with a jaw mechanism and handles, and, more particularly, to such a tool wherein the jaw mechanism and the handles deploy by rotation in opposite directions about axles lying in the plane of the jaw mechanism.

Implements with multiple deployable tools have long been known and used in the home, in the workplace, and in sporting applications. A folding pocket knife having two blades is an example. The blades are carried inside a handle for storage, and are selectively deployed, one at a time, when required to perform specific functions.

Pocket-knife-like devices, such as those produced by Wenger and Victorinox and commonly called "Swiss Army" knives, use this same principle extended to a plurality of tools carried within the body of the knife. Such implements typically incorporate a variety of types of blade-type tools, such as one or more sharpened blades, a screwdriver, an awl, a bottle opener, a magnifying glass, etc. The blade tools can also include mechanically functioning implements such as a pliers or scissors. The devices of this type are widely used and highly functional for many applications, but they have drawbacks. Generally, they are designed to be sufficiently small and light for carrying in a pocket and are therefore limited as to the strength and robustness of the tools. For example, the pliers or scissors found in Swiss Army knives are typically miniature in size and suited only for applications where large gripping forces are not required.

In recent years, devices known generically as "combination tools" have been developed and widely marketed. A combination tool typically is built around a jaw mechanism such as a full-size pliers head. The pliers head has handles fixed thereto. To make the combination tool compact yet capable of use in situations requiring the application of large forces, the handles are made deployable between a closed or nested position and an open or deployed position. When the handles are in the nested position, the combination tool is compact in size and can fit in a pocket or a pouch carried on a belt. When the handles are in the deployed position, they cooperate with the jaw mechanism to provide a full-size, full-strength pliers with which large forces can be applied.

A number of other types of blade tools are received in a folding manner within the handles themselves. As used herein in reference to tools received into the handles of the combination tool, or into the handle of a knife or comparable device, a "blade tool" refers to any relatively thin tool that is folded into one handle. Such blade tools are generally of the same types found in the Swiss Army knives, such as sharpened blades, screwdrivers, a bottle opener, a file, a small saw, an awl, etc. When a handle is in the deployed position, the blade tools folded into the handles are accessible and can be opened for use.

Combination tools of various designs are available from several manufacturers. The combination tools generally incorporate the features discussed above, and differ most noticeably in the mode of deployment of the pliers head. In the combination tool sold by Leatherman and described to some extent in U.S. Pat. Nos. 4,238,862 and 4,744,272, the handles fold open with a complex motion in the plane of the pliers movement. In the combination tool sold by Gerber and described in U.S. Pat. Nos. 5,142,721 and 5,142,844, the pliers head is slidably deployed from the handles. In the Paratool combination tool sold by SOG Specialty Knives and described in U.S. Pat. No. 5,267,366 and to some extent in U.S. Pat. Nos. 5,062,173, the handles fold in the same direction out of the plane of the pliers movement.

The existing tools, while functional, have drawbacks. The Leatherman tool requires a complex opening and closing motion and requires the user to grasp exposed channel edges of the handles when operating the pliers. The Gerber tool does not permit the handles to be opened to lie in a straight line, so that the use of the blade tools folded open from the handles is awkward in some instances and there is a risk of pinching the hand when the pliers are used. In the SOG Paratool, the pliers head is not easily moved between the nested and deployed positions, requiring a tab attachment to aid in the deployment. The SOG Paratool also produces an asymmetric clamping force when pressure is applied to the pliers head through the handles. In all cases, deployment of the pliers head can be difficult in some situations, such as when the user is wearing gloves.

There is a need for a combination tool that overcomes these and other problems, yet has the same advantages of other combination tools. The present invention fulfills this need, and further has related advantages.

SUMMARY OF THE INVENTION

The present invention provides a combination tool having a deployable jaw mechanism and folding handles with blade tools received in the handles. The combination tool is compact when the handles are nested, and fully functional when the handles are deployed. The handles are readily deployed or nested, even when the user is wearing gloves. When the handles are deployed and the combination tool is used as a pliers, the user grasps the folded side of the channel-shaped handle and can apply large clamping forces in a symmetric manner through the centerline of the combination tool and without discomfort. Any of the types of blade tools folded into the handles that are found on other types of combination tools, or other types of tools, can be used with the present approach. The combination tool has an "S" handle configuration that provides a large, comfortable gripping handle when the blade tools are to be used.

In accordance with the invention, a combination tool comprises a tool head including a jaw mechanism having two jaws lying in a tool head plane. A first handle is pivotably attached to the jaw mechanism and rotatable in a first direction about a first pivot axle lying in the tool head plane between a nested position wherein the first handle lies coplanar with and adjacent to the jaw mechanism and a deployed position wherein the first handle is coplanar with and remote from the jaw mechanism. A second handle is pivotably attached to the jaw mechanism and rotatable in a second direction (opposite to the first direction) about a second pivot axle lying in the tool head plane between a nested position wherein the second handle lies coplanar with and adjacent to the jaw mechanism and a deployed position wherein the second handle is coplanar with and remote from the jaw mechanism. The combination tool has a set of blade tools including a first blade pivotably received in the first handle, and a second blade pivotably received in the second handle. (As used herein in reference to blade tools received into the handles of the combination tool, a "blade" or "blade tool" refers to any relatively thin tool that is folded into the handle and received between the sides of the handle. Such a blade includes, but is not limited to, a sharpened knife blade, a screwdriver, a file, a small saw, an awl, a bottle opener, etc.)

In another embodiment, a combination tool comprises a tool head including a jaw mechanism having two jaws lying in a tool head plane, a first attachment lug extending from the jaw mechanism, and a second attachment lug extending from the jaw mechanism. A first handle mechanism includes a first handle pivotably attached to the first attachment lug of the tool head, and a first pivot axle lying in the tool head plane. The first handle is engaged to and rotatable about the first pivot axle in a first direction relative to the tool head plane between a nested position wherein the first handle is coplanar with the two jaws and adjacent to the two jaws and a deployed position wherein the first handle is coplanar with the two jaws and remote from the two jaws. A second handle mechanism includes a second handle pivotably attached to the second attachment lug of the tool head, and a second pivot axle lying in the tool head plane. The second handle is engaged to and rotatable about the second pivot axle in a second direction relative to the tool head plane between a nested position wherein the second handle is coplanar with the two jaws and adjacent to the two jaws and a deployed position wherein the second handle is coplanar with the two jaws and remote from the two jaws. The second direction is opposite to the first direction. There is a set of blade tools including a first blade pivotably received in the first handle and movable between a closed position wherein the first blade lies within the first handle and an open position wherein the first blade extends outside of the first handle, and a second blade pivotably received in the second handle and movable between a closed position wherein the second blade lies within the second handle and an open position wherein the second blade extends outside of the second handle. The first handle and the second handle are cooperatively shaped with the jaw mechanism such that the jaw mechanism is nested between and coplanar with the first handle and the second handle when the first handle and the second handle are in their nested positions and the first blade and the second blade are in their closed positions.

The first and second pivot axles may be angularly offset from each other, as by from about ½ to about 4 degrees. The first and second pivot axles may instead be collinear. In this latter form of the invention, the handles open with a lateral spacing that is constant or that increases as the handles move from the nested position to the deployed position (or conversely, a lateral spacing that decreases as the handles move from the deployed position to the nested position). The handles are conveniently moved laterally using a cam mechanism in either the pivot pin or the attachment leg and handle, or other type of lateral movement mechanism. Various detent structures for holding the handles in the open or closed positions can also be provided.

The present invention provides a combination tool that is more conveniently operated than existing types of combination tools. The handles are moved between the fully open and fully closed positions with an easily accomplished, straightforward circular motion that involves fewer, more natural movements than required for available combination tools. At intermediate positions of the handles, with one handle open and the other partially or completely closed, the blade tools in the handles are readily accessed and used. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a plan view of a combination tool with the handles fully unfolded to the deployed position;

FIG. 2 is a sectional view through one of the handles in FIG. 1, taken along line 2—2;

FIG. 3 is a plan view of the combination tool of FIG. 1, with the handles fully folded to the nested position;

FIG. 12 is a plan view like that of FIG. 1, of an embodiment wherein the pivot axles are collinear and the handles employ a first type of cam for lateral displacement;

FIG. 13 is a view of a detail of FIG. 12, taken along line 13—13;

FIG. 14 is a plan view like that of FIG. 1, of an embodiment wherein the pivot axles are collinear and the handles employ a second type of cam for lateral displacement;

FIG. 15 is a plan view like that of FIG. 1, of an embodiment wherein the pivot axles are collinear and the handles are displaced laterally by repositioning of the jaw pivot, with the jaw pivot positioned for a small gap between the handles;

FIG. 16 is a plan view of the combination tool of FIG. 15, with the jaw pivot repositioned for a large gap between the handles;

FIG. 17 is a plan view of the combination tool of FIG. 16, with the pliers jaw opened;

FIG. 18 is a schematic elevational view of a second embodiment of a handle detent portion of the combination tool of FIG. 1;

FIG. 19 is an elevational view of a handle detent spring used in the embodiment of FIG. 18; and FIG. 20 is a schematic elevational view of a third embodiment of a handle detent portion of the combination tool of FIG. 1;

DETAILED DESCRIPTION OF THE INVENTION

Figure 4:
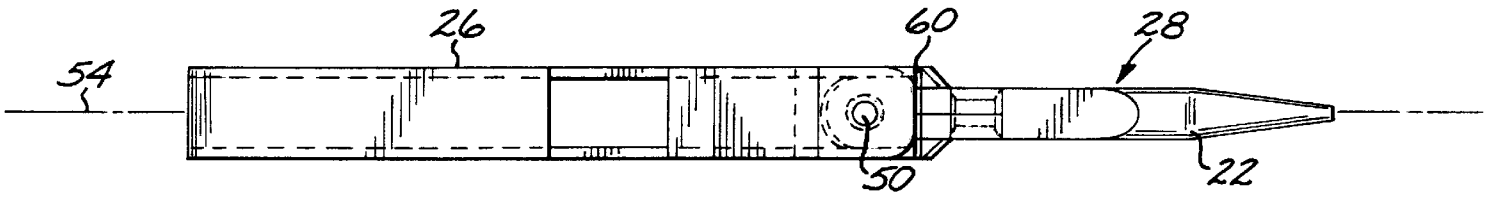
FIG. 4 is a side elevational view of the combination tool of FIG. 1 in the configuration depicted in FIG. 1.

FIG. 1 depicts a combination tool 20 having a tool head 22 and handles 24 and 26 attached thereto. The tool head 22 includes a jaw mechanism 28, illustrated as a pliers jaw mechanism, having two jaw sides that pivot about a jaw pivot 29. A first attachment lug 30 is fixed to one side of the jaw mechanism, and a second attachment lug 32 is fixed to the other side of the jaw mechanism.

The first handle 24 is pivotably attached to the first attachment leg 30 by a first pivot axle 35 that extends through the first attachment leg 30 and two arms 34 on the first handle 24. As shown in FIG. 2, the first handle 24 preferably is in the form of a channel having a first side 36, a second side 38, and a web 40 connecting the first side 36 and the second side 38. In this form, the sides 36 and 38 act as the arms 34. The channel opens inwardly, or, stated alternatively, the web 40 is found on the outwardly facing side of the first handle 24 which is grasped by a person using the pliers of the combination tool 20. A set of blade tools 42 is attached to that end of the first handle 24 that is remote from the pivot axle 35. The set 42 includes at least one blade 44, here illustrated as four blades, pivotably received in the channel form of the first handle and supported on a pivot pin 46. The blade 44 can pivot between a closed position, shown in FIG. 2, wherein the blade is received in the channel of the handle, and an open position (not shown) wherein the blade is extended outside of the first handle 24. As discussed previously, when the term "blade" is used herein in reference to deployable tools received into the handle of the combination tool, it refers to any relatively thin tool that is folded into the handle, regardless of the utilization of the tool. Such a "blade" therefore includes, but is not limited to, a sharpened knife blade, a screwdriver, an awl, a bottle opener, a file, a small saw, etc.

The second handle 26 is pivotably attached to the second attachment leg 32 by a second pivot axle 50 that extends through the second attachment leg 32 and two arms 52 on the second handle 26. The second handle 26 is in the form of a channel of generally the same construction as the first handle 24 with two sides and a web, except that the channel of the second handle 26 opens to the left in the view of FIG. 1. The set of deployable tools 42 includes at least one deployable blade pivotably affixed to an end of the second handle that is remote from the second pivot axle 50 with a pivot pin, as in the case of the first handle. The blades of the second handle 26 are pivotable between a closed position wherein the tools are received within the channel of the second handle, and an open position wherein the tools extend from the second handle.

Figure 5:
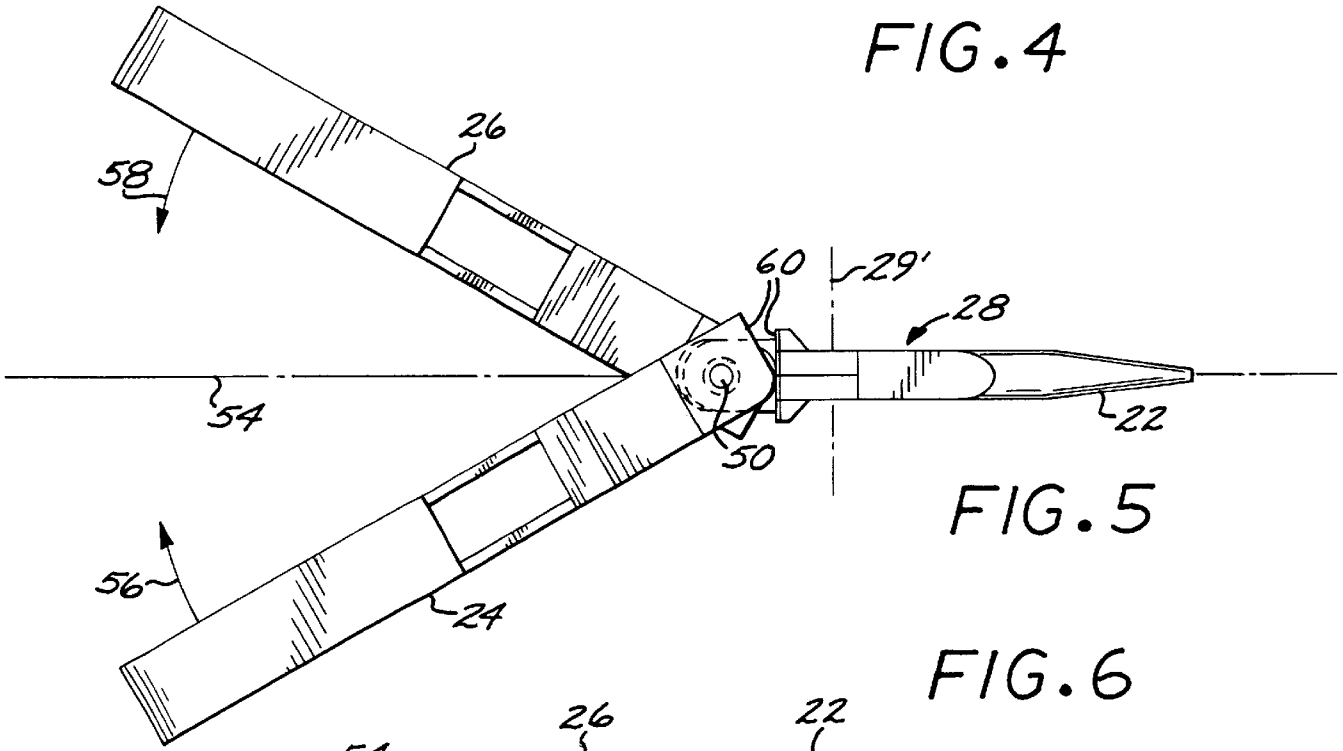
FIG. 5 is a side elevational view of the combination tool of FIG. 1, with the handles in a partially deployed position between the nested and deployed positions.
Figure 6:
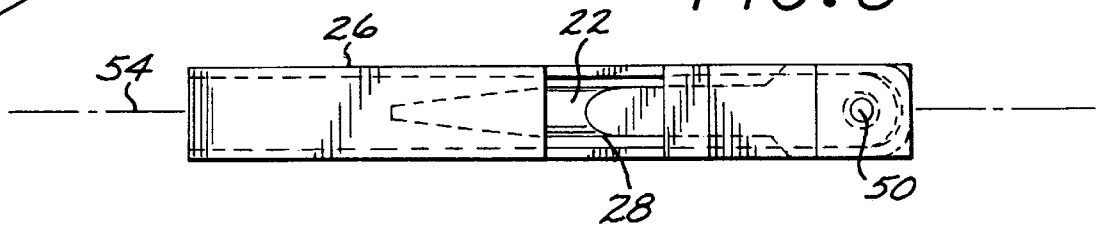
FIG. 6 is a side elevational view of the combination tool of FIG. 1, in the configuration depicted in FIG. 3.

FIGS. 1 and 3–6 illustrate the sequence of moving the handles 24 and 26 from the deployed or open position shown in FIGS. 1 and 4, through a partially deployed position shown in FIG. 5, and to a nested position shown in FIGS. 3 and 6. In the deployed position of FIGS. 1 and 4, the handles 24 and 26 lie in a tool head plane 54, which is the plane in which the two jaws of the pliers jaw mechanism 28 open and close and which lies perpendicular to an axis 29' of the jaw pivot 29. In the deployed position, the handles 24 and 26 are remote from the jaw mechanism 28; that is, the handles do not lie adjacent to the jaw mechanism. Stops 60 prevent the handles 24 and 26 from being pivoted past this deployed position. As shown in FIG. 4, the handles 24 and 26 are closed toward the nested position by pivoting them in opposite directions 56 and 58 about the respective axles 35 and 50 (axle 35 is not in view in FIGS. 4–6). Complete nesting or closure is accomplished when the handles 24 and 26 are pivoted 180° in opposite directions from the positions illustrated in FIGS. 1 and 4, to the position illustrated in FIGS. 3 and 6. At this point, the handles 24 and 26 and the jaw mechanism 28 are coplanar in the tool head plane 54, and the jaw mechanism is adjacent to and nested between the two handles 24 and 26.

For the greatest user convenience, the handles 24 and 26 are stably retained in the deployed (FIGS. 1 and 4) or in the nested (FIGS. 3 and 6) positions by detent mechanisms. The detent mechanisms provide a force that serves to hold the handles in the respective positions, but may be overcome by hand-applied force of the user. Any operable detent mechanism may be used, and some preferred detent mechanisms are illustrated in FIGS. 7, 8, 18, 19, and 20.

Figure 7:
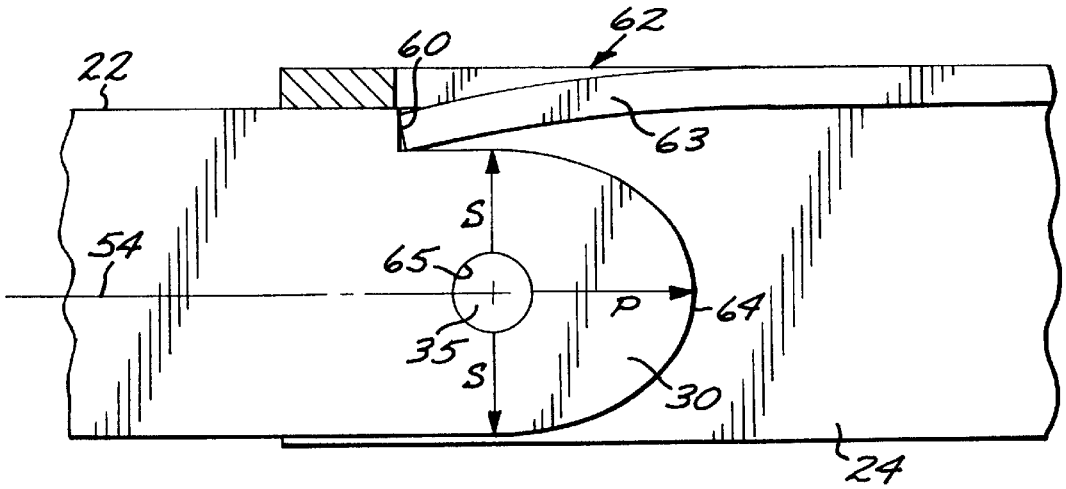
FIG. 7 is an enlarged sectional view of a handle detent portion of the combination tool of FIG. 1, taken along lines 7—7.
Figure 8A:
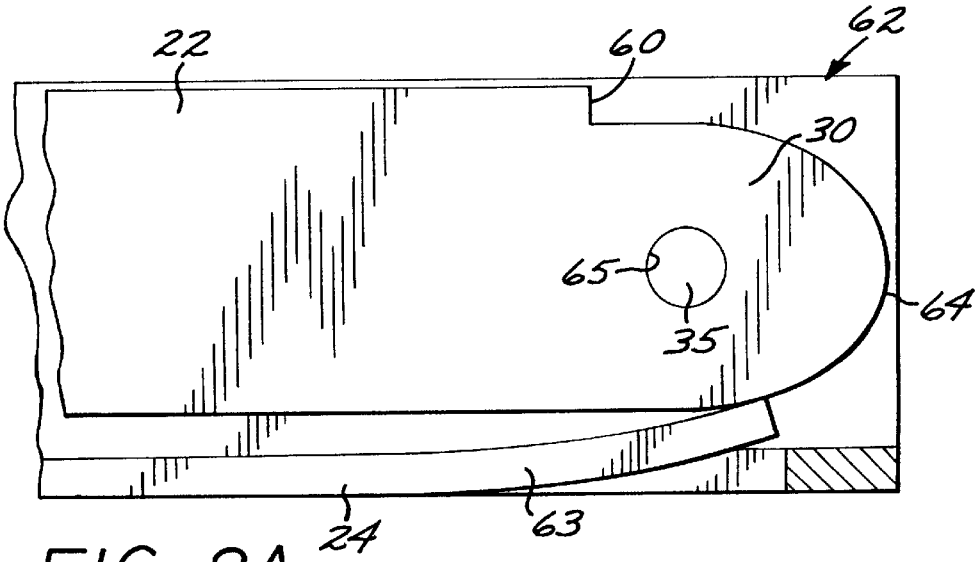
FIG. 8A is an enlarged sectional view of the handle detent portion of the combination tool of FIG. 3, taken along lines 8—8.

The detent mechanism 62 is illustrated in FIGS. 7 and 8 for the handle 24 (the same approach is used for the handle 26). The detent mechanism 62 includes a spring finger 63 formed as a leaf in the web 40 portion of the handle 24. The first attachment lug 30 is formed with a cam-shaped surface 64 with a bore 65 therethrough to receive the first pivot axle 35. The spring finger 63 is bent inwardly toward the bore 65 to ride on the cam-shaped surface 64, so that the spring finger 63 serves as a cam follower. The distance from the center of the bore 65 to the surface 64 in a direction lying in the tool head plane 54, distance p, is greater than the distance from the center of the bore 65 to the surface 64 in a direction lying perpendicular to the tool head plane 54, distance s. When the handle 24 is in either the fully deployed position of FIG. 7 or the fully nested position of FIG. 8A, the spring finger 63 relaxes inwardly toward the bore 65. When the handle is moved away from either of these positions, as in the semi-deployed position of FIG. 5, the spring finger 63 is forced away from the bore 65 by its contact with the cam surface 64. The cooperation of the cam surface 64 and the spring finger 63 thereby creates a restoring force tending to retain the handle in either the deployed or nested positions, but which restoring force can be overcome by hand force against the biasing force of the spring finger 63.

Figure 8B:
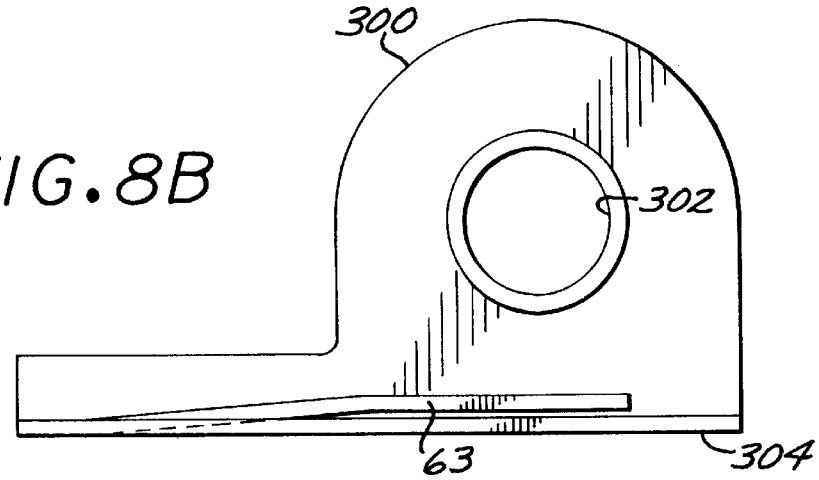
FIG. 8B is an enlarged view of another embodiment of the detent structure.

FIGS. 7 and 8A depict the spring finger 63 as integral with the web 40 of the handle 24. As shown in FIG. 8B, the spring finger 63 may equivalently be supported on a channel-shaped spring support 300 that fits between the two arms of the handle 24 with a bore 302 in the spring support 300 aligned with the bore 65, so that the pivot axle 35 extends through both bores 65 and 205. The spring finger 63 is formed as a leaf on a web 304 of the spring support 300, in the same position and with the same function as described above for the integral form of the spring finger 63 shown in FIGS. 7 and 8A. The approach of FIG. 8B may be preferably to that of FIGS. 7 and 8A in some circumstances, as the spring support 300 is fabricated as a separate piece and assembled to the handle 24.

Another embodiment of a detent mechanism 200 is illustrated in FIG. 18. The first attachment lug 30 includes two oppositely disposed raised cam surfaces 202, extending outwardly from the lug 30 perpendicular to the tool head plane 54 when the handle 24 is either closed (as shown in FIG. 18) or open. A spring 204, shown in greater detail in FIG. 19, fits between the two arms 34 of the handle 24 with a bore 205 in the spring 204 aligned with the bore 65, so that the pivot axle 35 extends through both bores 65 and 205. The spring 204 has two facing tabs 206 along its bottom surface. The tabs 206 are bent upwardly near their central regions, so as to engage the cam surfaces 202 and center the cam surfaces 202 between the tabs 206 when the handle 24 is either closed or open. To move the handle away from the closed location shown in FIG. 18, the leftmost tab 206 must be depressed by the hand force applied by the user of the tool as the handle 24 is opened.

A third embodiment of a detent mechanism 210 is illustrated in FIG. 20. The lug 30 is generally cylindrical in shape without cam surfaces, but there are two oppositely disposed notches 212 at positions on the surface of the lug 30 perpendicular to the tool head plane 54. A ball 214 is mounted to the inside of the one of the arms 34 and biased toward the lug 30 by a spring 216. The ball 214 is positioned at a location on a line erected from the center of the bore 65 perpendicular to the plane 54, such that the ball 214 engages one of the notches 212 when the handle 24 is either fully open or fully closed (as in FIG. 20). The spring 216 provides a detent force in either of these positions.

Figure 21:
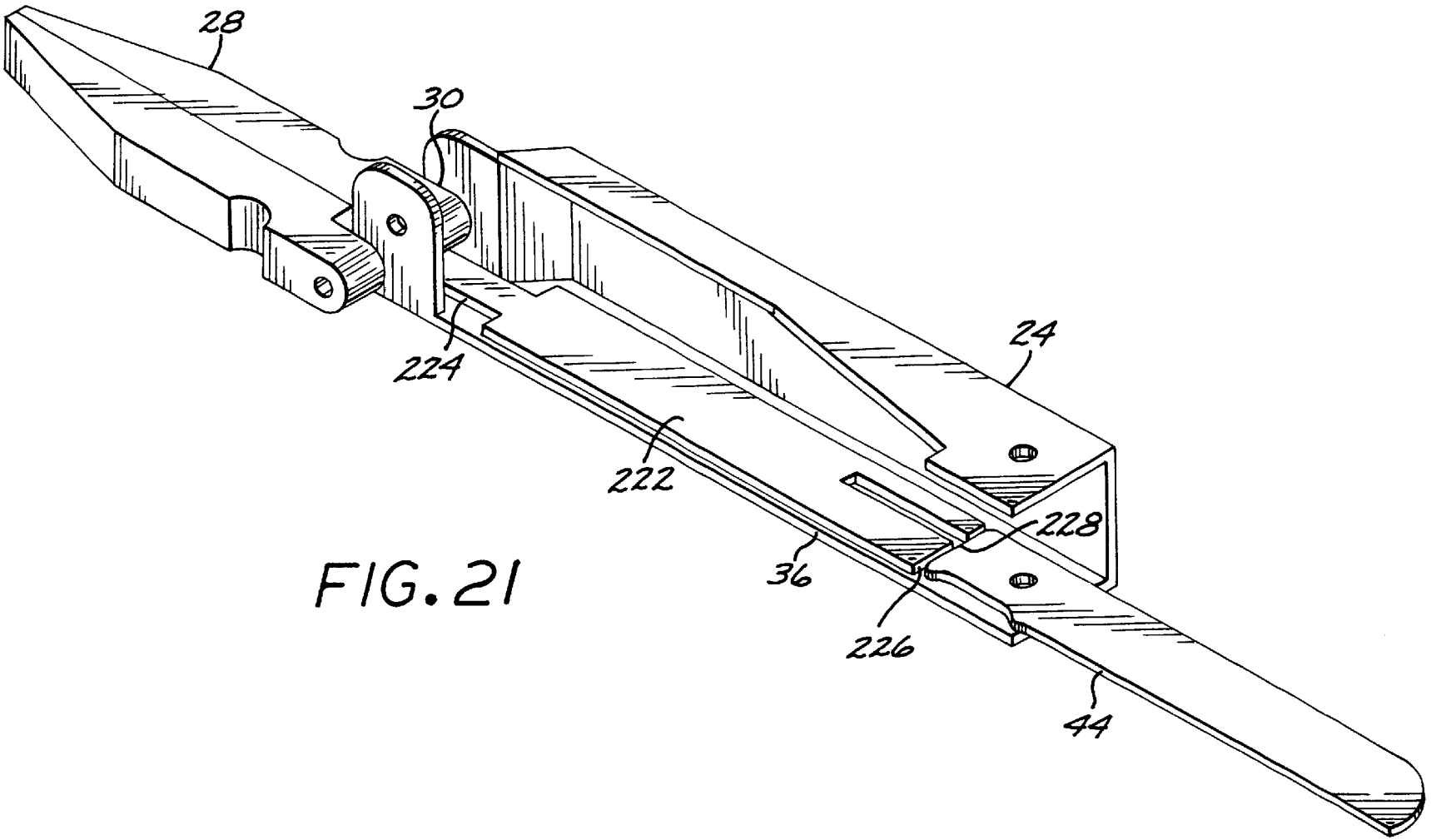
FIG. 21 is a fragmented perspective view of a fourth embodiment of a handle detent of the combination tool of FIG. 1.

A fourth embodiment of a detent mechanism 220 is illustrated in FIG. 21. The detent mechanism 220 includes a leaf spring 222 fixed along the interior of one side of the handle 24. An extension 224 of the leaf spring 222 engages the lug 30, which has the same general form as that shown in FIGS. 7–8. The reaction between the surface of the lug 30 and the extension 224 creates a detent force when the handle 24 is either in the open (as shown in FIG. 21) or closed position. An oppositely disposed locking surface 226 of the leaf spring 222 contacts a butt end 228 of the blade 44 when the blade 44 is in its open position, thereby locking the blade into the open position. The blade 44 may be released from the open position by pushing the end of the leaf spring 222 containing the locking surface 226 inwardly away from the side 36 so that the locking surface 226 clears the butt end 228 and the blade 44 may be rotated toward its closed position. Thus, the leaf spring 222 serves double duty as a detent spring for the jaw mechanism 28 and as a side-lock locking mechanism for the blade 44.

Figure 9:
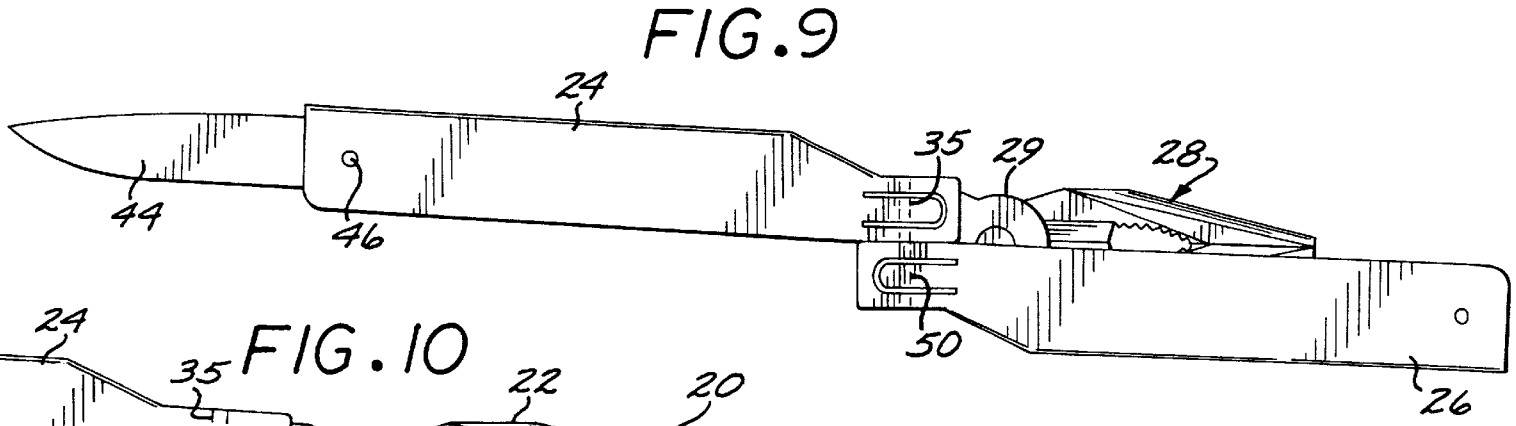
FIG. 9 is a plan view of the combination tool of FIG. 1, with one of the handles in the deployed position and a tool opened therefrom, and the other of the handles in the nested position.

Returning to the discussion of the general structure of the tool, FIG. 9 illustrates the preferred manner in which the handles are arranged, termed the "S" configuration, when one of the blades 44 is to be opened from one of the handles and used. In the case of the use of a blade 44 supported in the handle 24, the handle 24 is moved to the deployed position. The other handle 26 is moved to the nested position lying adjacent to the jaw mechanism 28. The handle 26 and the jaw mechanism 28 together form an ergonomically comfortable handle which the user grasps for secure holding and use of the blade 44, when the blade is a sharpened cutting blade. The handle 26 and jaw mechanism 28 can be further rotated about the pivot axle 35 to bring the jaw mechanism 28 to the nested position with the blade 44 opened and extended, providing a double-thick grip, if the user desires. In the event that the blade 44 is a screwdriver, awl, or other type of blade that requires the application of a torque during service, the handle 26 may be positioned at a right angle to the tool head plane to give additional leverage for operation of the blade 44. The present approach with oppositely folding handles thus provides great flexibility in selection of the most useful handle configuration for operating any selected blade.

Figure 10:
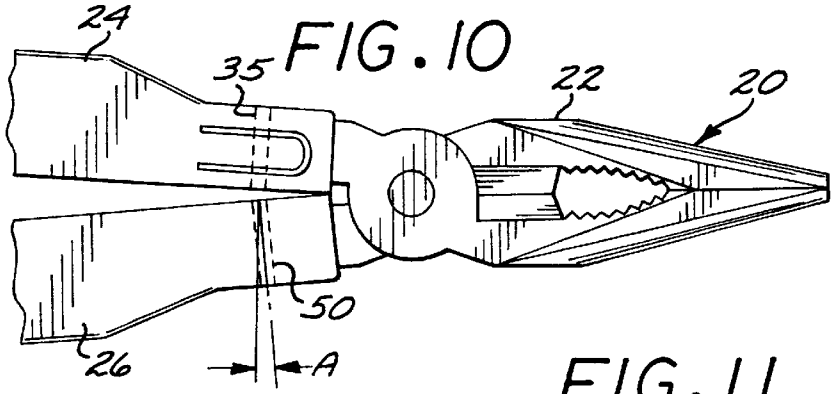
FIG. 10 is a fragmented plan view like that of FIG. 1, of an embodiment wherein the pivot axles are angularly offset from each other.

The approach to the opening and closing of the handles is compatible with any of several configurations of the handles in relation to the tool head. FIG. 10 shows a combination tool 20 wherein the pivot axles 35 and 50 are coplanar in the tool head plane 54 (the plane of the illustration of FIG. 10) but are angularly offset from each other by an angle A. The angle A is preferably from about ½ to about 4 degrees, most preferably about 2 degrees. The approach of angularly offset pivot axles has been described previously in U.S. Pat. No. 5,267,366 for a configuration in which the handles fold in the same direction as distinct from the present invention where the handles fold in opposite directions. With the approach of the present invention, the handles do not remain parallel to each other as they are rotated in opposite directions between the nested and deployed positions.

The present approach with angularly offset pivot axles has the advantage over that of the '366 patent in that the closing of the handles to the fully nested position, wherein the handles are coplanar with the tool head, is much more easily accomplished. In the design disclosed in the '366 patent, the two handles and the tool head are brought to the closed position simultaneously for interlocking. Considerable care must be taken to ensure that the three components (the two handles and the tool head) are moved to the coplanar, closed position simultaneously or the handles will not properly engage because of the shallow angle of approach of the two handles toward each other. In the present approach, the handles are brought to the nested position independently of each other, making closing easier.

Figure 11:
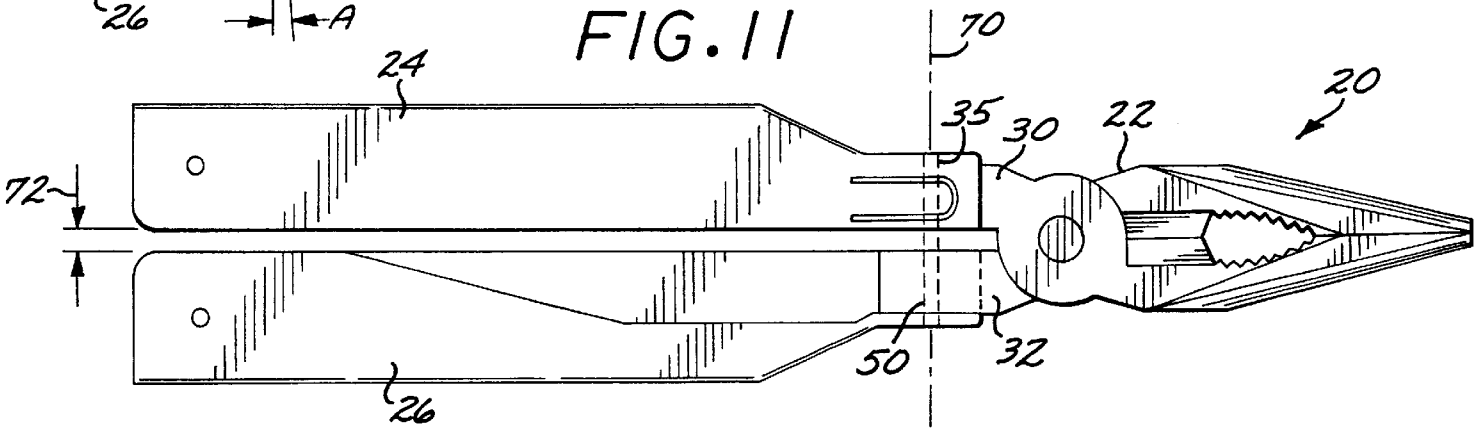
FIG. 11 is a plan view like that of FIG. 1, of an embodiment wherein the pivot axles are collinear and there is no lateral displacement mechanism for the handles.

A different approach is shown in FIGS. 11–14. In these embodiments, the pivot axles 35 and 50 are coplanar in the tool head plane 54 (the plane of the paper in the illustrations of FIGS. 11, 12, and 14), and are also coaxial along a common pivot axis 70. As a result, the handles rotate parallel to each other as they are rotated in opposite directions between the nested and deployed positions. It is preferred that the attachment lugs 30 and 32 be configured so that there is a gap 72 between the handles 24 and 26 when the handles are in the deployed position, as shown in FIG. 11. The gap 72 aids in avoiding the pinching of the user's hand during operation of the handles 24 and 26 to effect a pliers action. The provision of the gap 72 enlarges the envelope size of the combination tool when the handles are in the nested position, as compared with a case where there is no gap 72. The dimension of the gap 72 is selected as a compromise between having a gap sufficiently large to avoid pinching the fingers of the user and the envelope size of the combination tool 20. The gap 72 is preferably from about 1/16 to about ½ inch, most preferably about ¼ inch in dimension.

To reduce the envelope size when the handles are rotated to the nested position, a mechanism to effect lateral movement of the handles 24, 26 parallel to the common pivot axis 70, simultaneously with the rotation of the handles about the common pivot axis, is provided. Four embodiments are illustrated in FIGS. 12–17 and 22–23. In the embodiment of FIGS. 12–13, a helical groove 74 is provided in each pivot axle 34, 50. The helical groove 74 acts as a cam surface. A cam follower, shown as a cam follower pin 76, is placed into either the attachment leg 30 or the handle 26. (Equivalently, a second helical groove that meshes with the helical groove 74 may be substituted for the cam follower pin 76.) The cam follower pin 76 engages the helical groove 74, causing the handle 26 to move laterally parallel to the common pivot axis 70 when the handle 26 is rotated about the pivot axis 70 during movement of the handle 26 between the nested and deployed positions. The sense of the helical groove is selected such that the rotational movement of the handle 26 moves the handles laterally apart (but while staying parallel) as they are rotated toward the open position, thereby establishing the gap 72. Rotation of the handle 26 toward the nested position causes it to move laterally toward the other handle 24 (again while staying parallel) to close any gap therebetween and reduce the envelope size when the handles are brought to the fully nested position. This approach also has the important advantage that the angle of approach of the handles as they near the fully nested position is greater than for the approach of FIG. 10, making meshing and closure of the handles easier than for the approach of FIG. 10.

In another embodiment for accomplishing the lateral movement of the handles parallel to the common pivot axis 70 during rotation between the nested and deployed positions, camming surfaces are provided on those portions of the lateral sides of the attachment leg 32 and respective sides of the arms 52. As shown in FIG. 14, facing cam surfaces 78, 80 and 82, 84 are provided on the sides of the attachment leg 32 and the arms 52. The cam surface 78 on an inner arm 52*a* rides against the facing cam surface 80 on the attachment leg 32. The cam surface 82 on an outer arm 52*b* rides against the facing cam surface 84 on the attachment leg 30. The cam surfaces are selected such that the arms 24, 26 move apart from each other (while staying parallel to each other), parallel to the common pivot axis 70, when the arms 24 and 26 are rotated toward the deployed position to define the gap 72. Conversely, the arms 24 and 26 move toward each other (while staying parallel to each other), parallel to the common pivot axis 70, when the arms 24 and 26 are rotated toward the nested position. This approach yields the same advantages as described for the embodiment of FIGS. 12–13.

Another embodiment is illustrated in FIGS. 15–17. In this form, a jaw pivot 90 extends upwardly from one of the jaw members 92 of the pliers tool head 22. The jaw pivot is cylindrical with flats 94 formed on opposite sides thereof. A two-lobed bore 96 with lobes 96*a* and 96*b* extends through the other of the jaw members 98. Each of the lobes 96*a* and 96*b* is a portion of a cylinder. The dimension of the opening between the two lobes 96*a* and 96*b* and the spacing between the flats 92 are cooperatively chosen so that either of the lobes can rotate on the jaw pivot and also so that the jaw pivot 90 can be slipped between either of the lobes 96*a* and 96*b* by aligning the flats with the opening. This approach is known for conventional pliers.

The combination tool is illustrated in FIG. 15 with the jaw pivot 90 residing in the bore lobe 96*a*, resulting in a small gap 72 between the handles 24 and 26. If the jaw pivot 90 is moved to the bore lobe 96*b*, the gap 72 is substantially larger to lessen the likelihood of pinching of the palm of the hand of the user as the jaw mechanism is operated. As a secondary benefit, when the jaws 92 and 98 are opened, the jaws will accommodate a larger gripped object 100 when the jaw pivot is positioned in the bore lobe 96*a* than when it is in the bore lobe 96*b*. The positioning of the jaw pivot 90 relative to the lobes 96*a* and 96*b* thus determines both the size of the gap 72 between the handles and the size of the object 100 that may be gripped, as well as the leverage and force that may be applied to the gripped object 100.

Figures 22, 23:
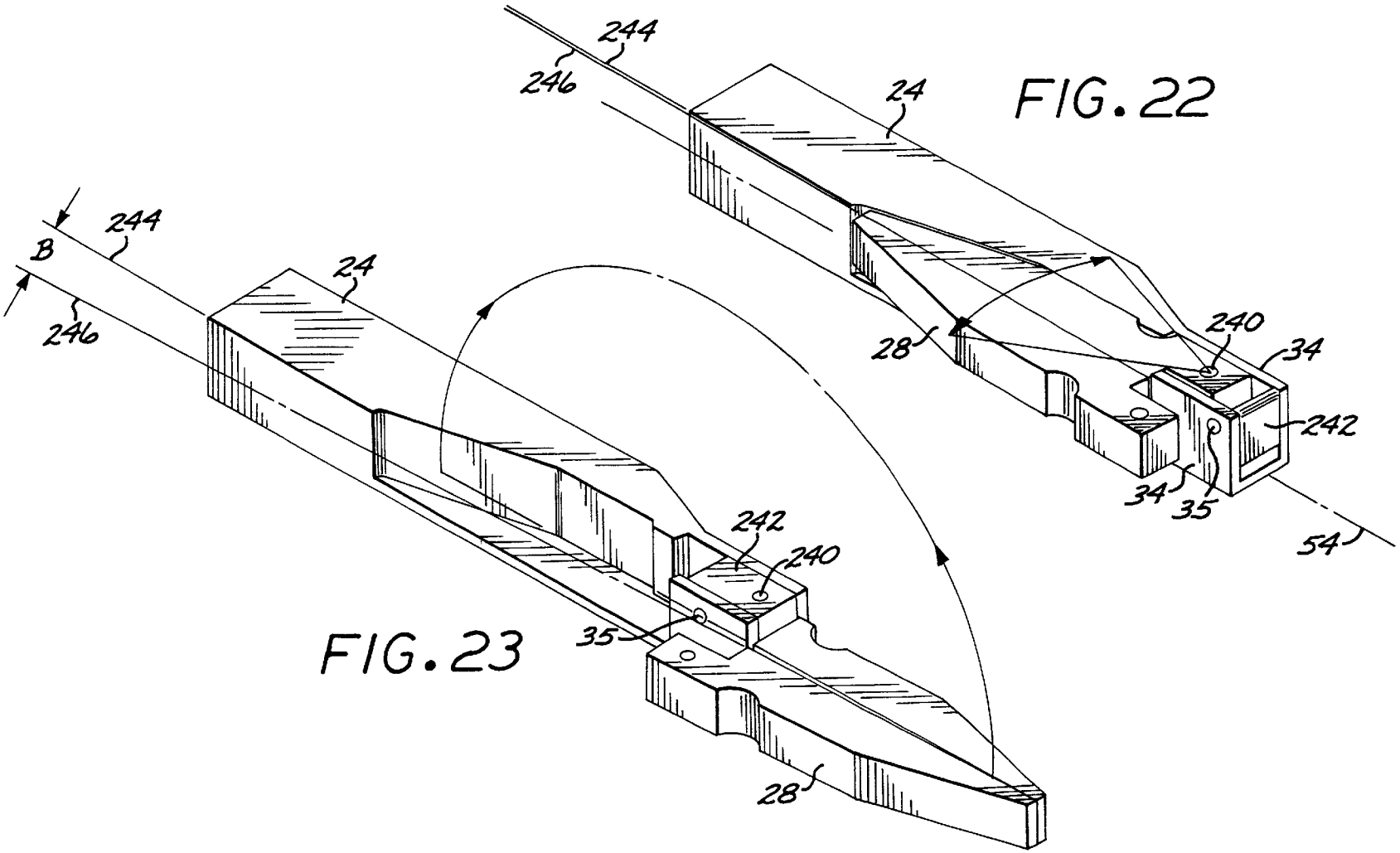
FIG. 22 is a fragmented perspective view of an embodiment of the combination tool wherein the pivot axles are collinear when the jaw mechanism is in the nested position.
FIG. 23 is a fragmented perspective view of combination tool of FIG. 22, with the jaw mechanism in the deployed position.

FIGS. 22 and 23 illustrate another approach to the jaw opening and closing configuration in the nested and deployed positions, respectively. The jaw mechanism 28 is pivotably attached by a handle pivot pin 240 extending perpendicular to the plane 54, to a handle pivot body 242. The handle pivot body 242 is, in turn, pivotably attached between the arms 34 by the pivot axle 35. The arms 34 are not parallel, but instead are tapered by a small amount, on the order of about ½–4 degrees, most preferably 2 degrees, with respect to each other. When the jaw mechanism 28 is in the nested position of FIG. 22, an axis 246 of the jaw mechanism 28 is aligned with an axis 244 of the handle 24. When the jaw mechanism 28 is opened to the deployed position of FIG. 23 by pivoting on the axle 35, the jaw mechanism 28 also pivots in the plane 54 on the pivot pin 240 so that the axis 246 of the jaw mechanism 28 is angularly offset from the axis 244 of the handle 24 by an angle B, preferably on the order of about ½–4 degrees. This angular offset creates the gap between the handles as the handles are opened, so that the hand of the user is not pinched when the handles are operated to operate the jaw mechanism.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination tool, comprising:

a tool head including a jaw mechanism having two jaws lying in a tool head plane, a first attachment lug extending from the jaw mechanism, and a second attachment lug extending from the jaw mechanism;

a first handle mechanism including a first handle pivotably attached to the first attachment lug of the tool head, and a first pivot axle lying in the tool head plane, the first handle being engaged to and rotatable about the first pivot axle in a first direction relative to the tool head plane between a nested position wherein the first handle is coplanar with the two jaws and adjacent to the two jaws and a deployed position wherein the first handle is coplanar with the two jaws and remote from the two jaws;

a second handle mechanism including a second handle pivotably attached to the second attachment lug of the tool head, and a second pivot axle lying in the tool head plane, the second handle being engaged to and rotatable about the second pivot axle in a second direction relative to the tool head plane between a nested position wherein the second handle is coplanar with the two jaws and adjacent to the two jaws and a deployed position wherein the second handle is coplanar with the two jaws and remote from the two jaws, the second direction being opposite to the first direction;

a set of blade tools including a first blade pivotably received in the first handle and movable between a closed position wherein the first blade lies within the first handle and an open position wherein the first blade extends outside of the first handle, and a second blade pivotably received in the second handle and movable between a closed position wherein the second blade lies within the second handle and an open position wherein the second blade extends outside of the second handle, the first handle and the second handle being cooperatively shaped with the jaw mechanism such that the jaw mechanism is nested between and coplanar with the first handle and the second handle when the first handle and the second handle are in their nested positions and the first blade and the second blade are in their closed positions.

2. The combination tool of claim 1, further including a first handle detent in the deployed position, and a second handle detent in the deployed position.

3. The combination tool of claim 1, further including a first handle detent in the nested position, and a second handle detent in the nested position.

4. The combination tool of claim 1, wherein the first pivot axle and the second pivot axle are angularly offset from each other.

5. The combination tool of claim 1, wherein the first pivot axle and the second pivot axle are angularly offset from each other by an amount of from about ½ to about 4 degrees.

6. The combination tool of claim 1, wherein the first pivot axle and the second pivot axle are collinear.

7. The combination tool of claim 6, wherein the first handle mechanism further includes means for driving the first handle parallel to the first pivot axle as the first handle is rotated about the first pivot axle from its deployed position toward its nested position, and wherein the second handle mechanism further includes means for driving the second handle parallel to the second pivot axle as the second handle is rotated about the second pivot axle from its deployed position toward its nested position.

8. The combination tool of claim 6, wherein the first handle mechanism further includes a helical first-handle cam groove on the first pivot axle, and a first-handle cam follower on one of the first attachment lug and the first handle, wherein the first-handle cam follower is engaged to the first-handle cam groove.

9. The combination tool of claim 8, wherein the second handle mechanism further includes a helical second-handle cam groove on the second pivot axle, and a second-handle cam follower on one of the second attachment lug and the second handle, wherein the second-handle cam follower is engaged to the second-handle cam groove.

10. The combination tool of claim 6, wherein the first handle mechanism further includes a first-handle first cam surface on the first attachment lug, and a first-handle second cam surface on the first handle, wherein the first-handle first cam surface is engaged to the second-handle second cam surface such that the first handle is driven parallel to the first pivot axle as the first handle is rotated about the first pivot axle from its deployed position toward its nested position.

11. The combination tool of claim 10, wherein the second handle mechanism further includes a second-handle first cam surface on the second attachment lug, and a second-handle second cam surface on the second handle, wherein the second-handle first cam surface is engaged to the second-handle second cam surface such that the second handle is driven parallel to the second pivot axle as the second handle is rotated about the second pivot axle from its deployed position toward its nested position.

12. The combination tool of claim 1, wherein the jaw mechanism comprises a pliers jaw.

13. The combination tool of claim 1, wherein the first handle and the second handle are each in the form of a channel having a first side lying parallel to the tool head plane, a second side lying parallel to the tool head plane, and a web connecting the first side and the second side.

14. The combination tool of claim 1, wherein the jaw mechanism comprises a jaw pivot pin extending from the first attachment lug perpendicular to the tool head plane, and a two-lobed bore extending through the second attachment lug and receiving the jaw pivot pin therethrough.

15. The combination tool of claim 1, wherein the first handle further includes a handle pivot therein at a location adjacent to the first pivot axle and disposed perpendicular to the first pivot axle.

16. A combination tool, comprising:

a tool head including a jaw mechanism having two jaws lying in a tool head plane;

a first handle pivotably attached to the jaw mechanism and rotatable in a first direction about a first pivot axle lying in the tool head plane between a nested position wherein the first handle lies coplanar with and adjacent to the jaw mechanism and a deployed position wherein the first handle is coplanar with and remote from the jaw mechanism, a second handle pivotably attached to the jaw mechanism and rotatable in a second direction about a second pivot axle lying in the tool head plane between a nested position wherein the second handle lies coplanar with and adjacent to the jaw mechanism and a deployed position wherein the second handle is coplanar with and remote from the jaw mechanism; and a set of blade tools including a first blade pivotably received in the first handle, and a second blade pivotably received in the second handle.

17. The combination tool of claim 16, wherein the first pivot axle and the second pivot axle are angularly offset from each other.

18. The combination tool of claim 16, wherein the first pivot axle and the second pivot axle are collinear.

* * * * *